US006250036B1

(12) United States Patent
Nurley et al.

(10) Patent No.: US 6,250,036 B1
(45) Date of Patent: Jun. 26, 2001

(54) SOUND CONTROL SYSTEM FOR STEEL ROOF DECKS

(75) Inventors: C. Lynn Nurley, Duluth; Robert G. Jones, Jr., Alpharetta; Joseph B. Shepard, Marietta, all of GA (US)

(73) Assignee: Loadmaster Systems, Inc., Norcross, GA (US)

( * ) Notice: Subject to any disclaimer, the term of this patent is extended or adjusted under 35 U.S.C. 154(b) by 0 days.

(21) Appl. No.: 09/516,473

(22) Filed: Mar. 1, 2000

(51) Int. Cl.[7] ..... E04B 7/00
(52) U.S. Cl. ..... 52/537; 52/408; 52/588.1
(58) Field of Search ..... 52/408, 409, 410, 52/536, 537, 538, 540, 588.1, 506.01–506.05, 671–674, 783.17–783.19, 144

(56) References Cited

U.S. PATENT DOCUMENTS 3,388,516 * 6/1968 Thielen ..... 52/408
4,014,148 * 3/1977 Harter ..... 52/537
4,192,108 * 3/1980 Lowe ..... 52/537 X
5,392,583 * 2/1995 Gregory ..... 52/408 X
5,685,118 * 11/1997 Simpson ..... 52/537 X
5,855,101 * 1/1999 Schute et al. ..... 52/506.05
5,950,383 * 9/1999 Williamson et al. ..... 52/408

* cited by examiner

*Primary Examiner*—Richard Chilcot
(74) *Attorney, Agent, or Firm*—Crutsinger & Booth

(57) ABSTRACT

A steel roof deck diaphragm to provide structural rigidity to a building wherein loads of varying intensity can cause movement of structural members, which tends to generate noise when two members rub or work against each other. Corrugated sheets of high tensile steel are supported from below and span the distance between purlins, the corrugated sheets having over-lapping side edges and end edges and upper and lower surfaces. Non-metallic strips of felt form spacers positioned between the over-lapping side edges and end edges to prevent generation of noise resulting from relative movement of the corrugated sheets.

20 Claims, 4 Drawing Sheets

SOUND CONTROL SYSTEM FOR STEEL ROOF DECKS

TECHNICAL FIELD

A steel roof deck diaphragm having non-metallic spacers between over-lapping side edges and end edges of steel sheets to prevent noise resulting from relative movement of the sheets and resilient cushions between the steel sheets and supporting purlins.

BACKGROUND OF INVENTION

Roof deck systems, composed of a high tensile steel base with thermal insulation and high performance mineral board mechanically anchored to the steel sections, provide composite strength. The resultant assembly is a strong, durable substrate for roofing applications. Composite roof deck assemblies are disclosed in U.S. Pat. No. 4,601,151; U.S. Pat. No. 4,736,561; U.S. Pat. No. 4,707,961; U.S. Pat. No. 4,783,942 and U.S. Pat. No. : 5,584,153.

Corrugated steel sections are positioned over structural supports and anchored in place with welded connections through special weld washers, of the type disclosed in U.S. Pat. No. 4,601,151, or with mechanical fasteners. Thermal insulation, available in a variety of types and thicknesses, is placed over the steel sections. High density tongue-and-grooved mineral board panels are placed over the thermal insulation or directly on the steel sections.

Corrosion resistant screw fasteners anchor the thermal insulation and mineral board to the steel sections, thereby developing composite strength and stability for the roofing foundation. Corrosion resistant compression discs provide concentrated load deflection continuity at all abutting mineral board locations. Pressure sensitive weather resistant tape is applied over all mineral board joints to provide a continuous plane across the joints of the roof covering foundation. With the application of joint tape, the roof deck assembly is complete and ready to receive the roof covering.

U.S. Pat. No. 4,601,151 discloses a roof system comprising a sheet of corrugated material having ridges and a rigid substrate, such as a mineral board, fastened to the upper ridges of the corrugated sheet. The corrugated sheet is welded to roof purlins. The mineral board, on the other hand, is fastened to the corrugations of the corrugated sheet by threaded fasteners which extend through the mineral board and through the ridges to form a truss-like structure that spans between the roof purlins.

When an insulated roof is desired, insulation is interposed between the mineral board and the corrugated sheet. As the insulation thickness increases the length of the threaded fasteners increases, creating potential rotation and bending problems for the fasteners. As a result, the thickness of the insulation is limited by the threaded fastener length. Additionally, since fasteners typically extend all the way through the roofing layers from the exterior of the roof to the interior supporting structure of the roof, thermal shorts may be created between the exterior of the roof and the interior of the roof, which is undesirable in extremely hot or cold climates.

Although the roof may be well insulated, the temperature of the metallic sheets changes significantly during a 24 hour period when the temperature gradient between the interior and exterior of the building is high. For example, the temperature of a steel deck on an air-conditioned building will gradually increase and decrease. Thermal expansion and contraction of the steel sheets and the steel purlins can cause movement of adjacent surfaces, which generates noise when the surfaces rub or work against each other. Expansion and contraction creates noise at the juncture between edges and ends of the sheets and between the lower surface of the sheets and upper surfaces of the purlins which support them.

Architectural designs may feature roofs which are flat or inclined without an insulated ceiling between the roof and the interior of the building. Generally, an insulated ceiling will serve as an acoustical barrier so that popping and cracking noises resulting from thermal expansion of the steel roof deck is not a problem. However, when the insulated ceiling is eliminated, unwanted noise may become a problem. For example, in the sanctuary of a church, constructed without a ceiling, in a hot sunny climate, thermal expansion of steel sheets in the roof deck may result in excessive noise during church services. The noise is particularly noticeable during prayer or other periods of silence.

Recently, exposed steel composite roof decks have been utilized more and more on specialized applications where no ceiling is utilized and the roof deck is exposed on the interior of the structure. While this type of construction is not new, designers have found themselves more and more on projects where the interior use of the structure requires a high degree of "quietness." When exposed steel composite roof decks are used on church sanctuaries, where during prayer and meditation times, the occupants expect quiet to reign within the building. Other buildings such a libraries, media centers, condominiums and classroom teaching areas are also using this type of design.

It has been reported that under certain conditions and at particular times of the year, ministers had trouble conducting services because of the popping and crackling noises emanating from the roof deck. The noises, popping sounds, occurred every two to three seconds and were very distracting. The noise level reached its peak at high noon, or during maximum thermal exposure, which is often the time for church services.

Investigation revealed that while the noises were not exactly the same in all cases, the degree of disturbance was real in all cases and a solution to the noise problem was required if this type of architectural design were to be implemented successfully.

The noise can be generated by three separate conditions.

Condition 1: Interior of the Building

Movement of the steel deck section within the assembly produced popping noises. This movement can be caused by walking over the deck surface or, as more commonly seems to occur, by thermal changes of the steel section due to heat loading from the sun. It has been observed that, even in highly insulated roof deck assemblies (R=30 type of insulation), the temperature of the steel deck can cycle up to 40 or 50 degrees F. during a normal day. This change in temperature produced movement of the steel deck section. Additionally, friction between the top of the steel section and components, such as thermal insulation or mineral board, laid directly on top of the steel also produce noise.

Condition 2: Perimeter of Building

The same situation exists where the building has steel supporting members exposed to the outside temperatures, such as at overhangs. The supporting steel moves under thermal changes and causes movement of the steel decking, which causes noises or popping. The popping noise is generated at the contact points between the steel deck and the steel supporting structure.

Condition 3: Metal Roofing

It was observed that most metal roofs make noises when expanding and contracting under thermal change.

A need exists for a method and apparatus for preventing unwanted noise as a result of thermal expansion or other variable loading of structural members and particularly between structural members used in roof decks.

SUMMARY OF INVENTION

We have found that by isolating the steel deck sections from contact with all steel surfaces, the noise created by deck movement could be eliminated. We placed sound deadening material such as a heavy felt, between the supporting structure and the steel sheets, so that the steel roof deck sheets did not touch the steel supporting structure. Further, deadening felt was positioned between each side lap and end joint of the steel sheets, so that the steel sheets did not touch each other, even though they are side lapped one full corrugation and end lapped about three inches.

The steel sheets were then anchored in place with a non-destructive anchor. On the test frame, powder actuated pins were used. However, we contemplate the use of screws when solid spacer material is used and welding through openings or between segments of spacer.

The entire top surface of the steel deck is covered with the same deadening felt prior to placing the insulation over the steel deck.

After completing the assembly, with all screws, etc. installed, the roof deck was tested for sound and found it to be sound free. The popping sound was eliminated by isolating the steel from direct contact with any other component.

While conventional glass roofing felt was used as the isolator, we contemplate the use of non-saturated felts and certain types of glass tapes to improve the combustible aspects and aid in the installation.

The method and apparatus disclosed herein preferably includes non-metallic spacers positionable between adjacent edge and end surfaces of sheets of formed steel to prevent rubbing between adjacent surfaces resulting from expansion or contraction of the sheets. The spacer is sufficiently resilient to permit limited relative movement of adjacent surfaces, but sufficiently rigid and of a thickness which does not permit sufficient movement to detract from the diaphragm strength of the roof deck. Thus, the spacers eliminate the need for insulated ceilings or other noise barriers in the facility.

Several different embodiments of suitable spacers are disclosed. In the first embodiment, strips of glass roofing felt are positioned between side and end surfaces of the steel sheets and between upper surfaces of purlins and lower surfaces of the steel sheets. It is contemplated that the strips of glass roofing felt may be replaced with strips of polymeric membrane of the type disclosed in U.S. Pat. No. 4,707,961. In a second embodiment of as the invention, strips of polyurethane foam are formed by spraying strips along upper and lower edges of the sheets such that metallic surfaces at joints between over-lapping side edges and end edges of adjacent sheets are not in rubbing engagement with each other. In a third embodiment, generally U-shaped molding strips are configured to grippingly engage the edge of a sheet, the molding being generally channel-shaped such that at least one flange is positioned between adjacent metallic surfaces at the joints between adjacent sheets.

A coating of non-conductive material, such as Teflon, is preferably formed on threaded fasteners used for securing adjacent edges of the sheets together to prevent metal-to-metal contact between the portion of the screws adjacent the head with the metal sheets through which the screws extend.

DESCRIPTION OF THE DRAWINGS

Drawings of a plurality of preferred embodiments of the invention are annexed hereto, so that the invention may be better and more fully understood, in which.

Numeral references are employed to designate like parts throughout the various figures of the drawing.

DESCRIPTION OF A PREFERRED EMBODIMENT

Figure 1:
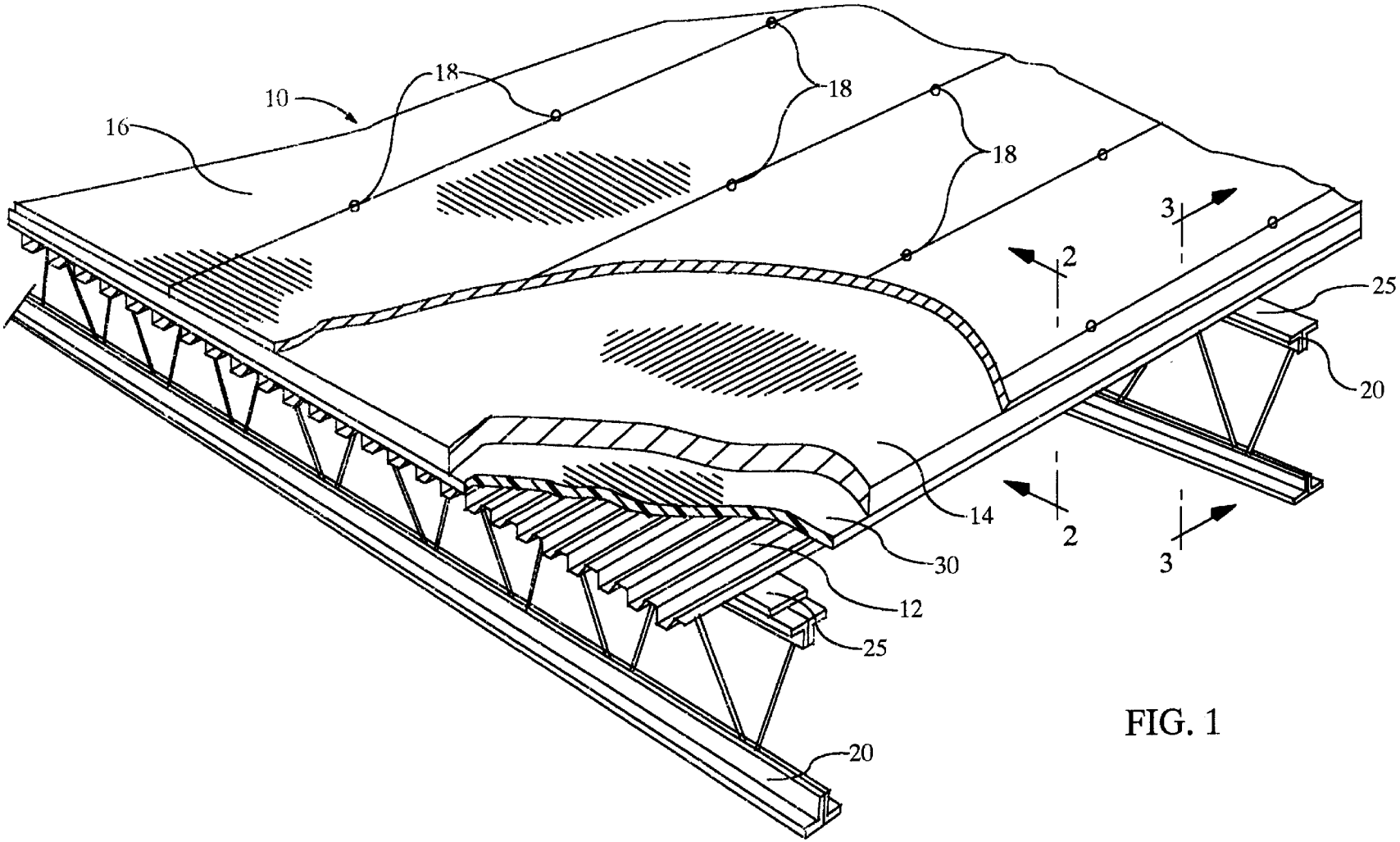
FIG. 1 is a fragmentary perspective view of a roof deck supported by purlins.
Figure 2:
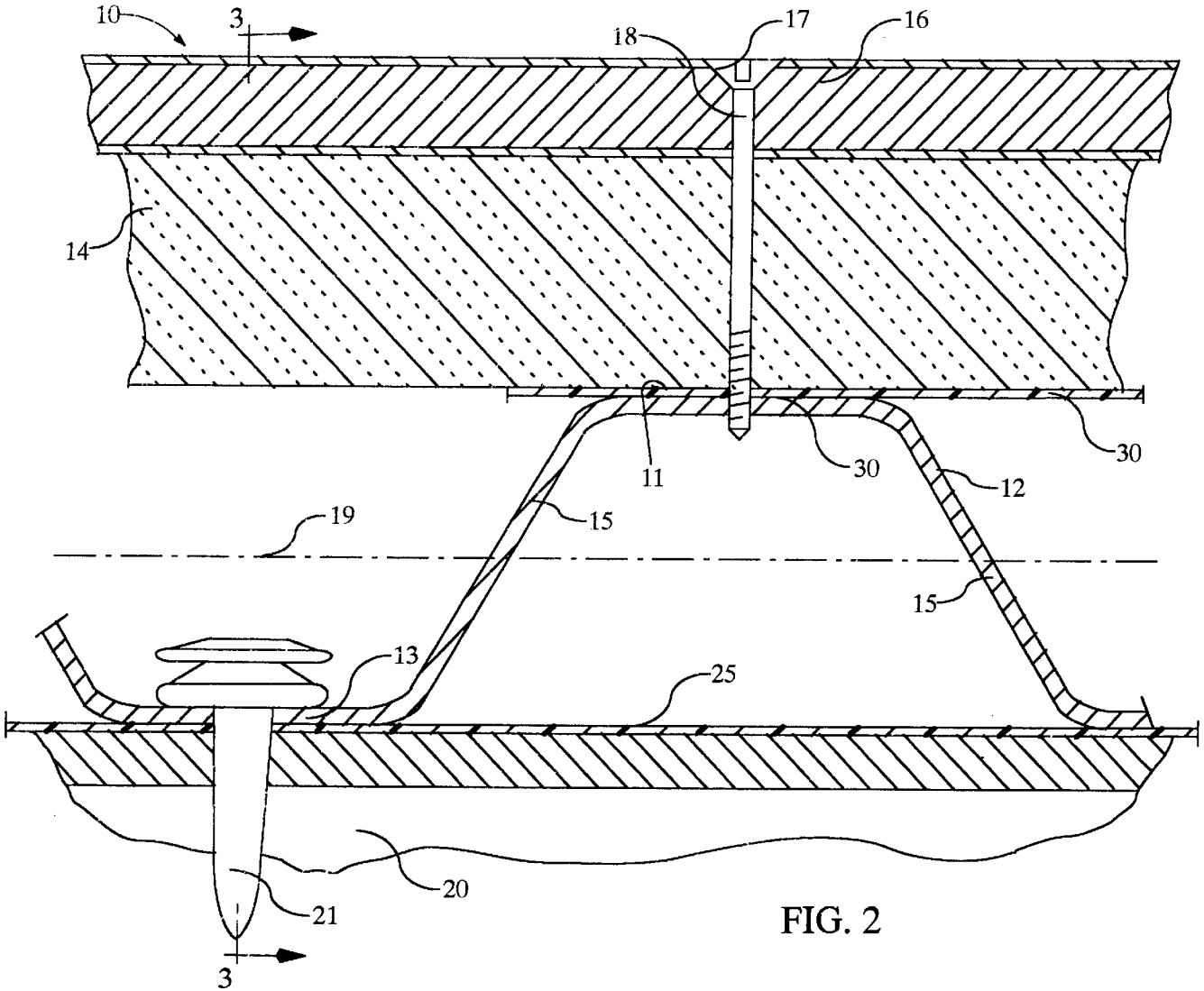
FIG. 2 is a cross-sectional view taken substantially along line 2—2 of FIG. 1.
Figure 3:
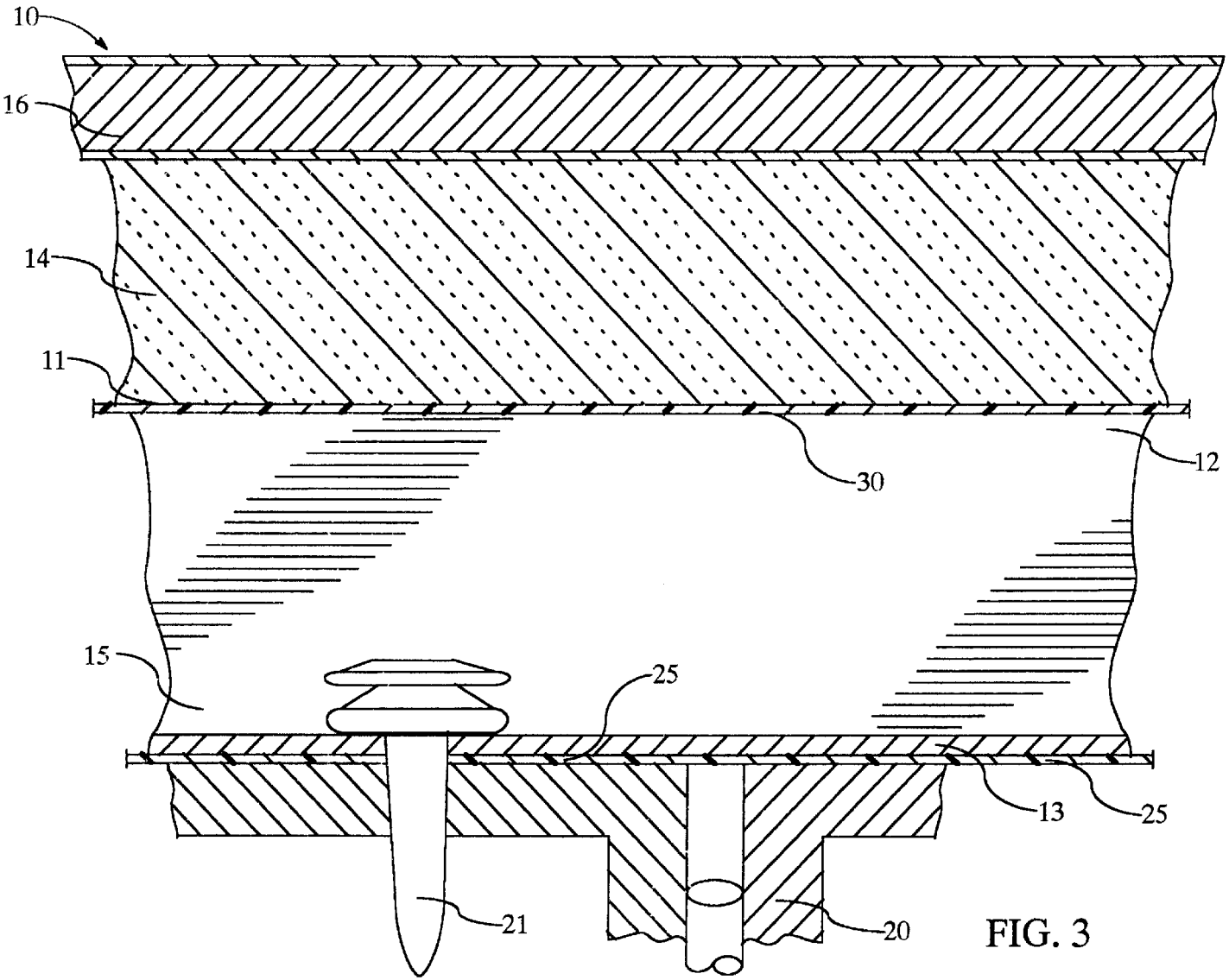
FIG. 3 is an enlarged cross-sectional view taken substantially along line 3—3 of FIG. 1.

Referring to FIGS. 1, 2 and 3 of the drawings, the numeral 10 generally designates a steel roof deck comprising a plurality of sheets 12 of corrugated material, optional sheets 14 of foamed insulation material and sheets 16 of rigid mineral board, the sheets of mineral board 16 being secured by screws 18 to ridges 11 of the corrugated sheets, as will be hereinafter more fully explained. Valleys 13 of the corrugated sheet are secured to span across space between purlins 20, which in the illustrated embodiment are formed by open web steel joists. Valleys 13 are preferably secured to purlins 20 by powder actuated drive pins 21, self drilling screws or by welding.

Corrugated sheet 12 preferably has flat ridge portions 11 and flat valley portions 13 of substantially equal length joined by connector portions 15 providing straight, parallel, regular and equally curved ridges and hollows. As best illustrated in FIG. 2, this configuration has a substantially equal distribution of surface area of the corrugated sheet above and below a neutral axis 19.

The sheet 14 of insulation material preferably comprises a closed cell foamed material such as polystyrene or polyisocyanurate formulated to provide a high degree of thermal insulating quality at ambient atmospheric temperatures. This component is optional and is used when a high degree of thermal insulation is desired.

Sheet 16 of mineral board preferably comprises a flat smooth sheet of incombustible, water resistant, fiberglass reinforced material having an impervious paper cover to permit migration of moisture from the mineral board when hot asphalt is applied thereto.

Screws 18 extend through sheets 14 of thermal insulation and sheets 16 of mineral board and are anchored in upper ridges 11 of corrugated sheet 12. It will be appreciated that screws 18 secure sheets 14 and 16 relative to upper ridges 11 of the corrugated sheet but do not extend into purlins 20. Thus, screws 18 contribute to the shear strength and shear stiffness of roof deck 10, but are not employed for securing the roof deck to the purlins.

It should be noted that screws 18 have enlarged heads 17 which engage the rigid sheet 16. As hereinbefore noted, sheet 14 of thermal insulation material has very low density and consequently has sufficient internal strength to hold screw heads 17 without pulling through the material.

The roof deck assembly 10 provides a flat surface having sufficient strength to support a waterproof roofing membrane and permits use of a symmetrical rib pattern in the corrugated sheet 12 which provides both flexural and diaphragm shear strength and shear stiffiess when the upper ridges 11 are restrained against movement in a horizontal direction by the flat sheet 16 and screws 18.

Ridges 11 are in compression when a downwardly directed force is applied to the upper surface on the roof deck. Ridges 11 on the thin corrugated sheet 12 are somewhat analogous to a slender column when in compression. Screws 18 are positioned such that the unsupported length of the thin ridges is significantly less than the distance between spaced purlins 20 to increase the load carrying capability of corrugated sheet 12. The horizontally disposed sheet 16, screws 18, and connector portions 15 of the symmetrically corrugated sheet 12 of high tensile strength steel interact to form a truss-like structure extending generally parallel to the purlins intermediate ends of the span. This truss-like structure greatly increases the shear strength of the corrugated sheet 12.

If corrugated sheet 12 is 32 feet long, spanning over purlins 20 spaced apart 8 feet, the total expansion of sheet 12 is approximately 0.124 inches (⅛ inch) as a result of a 50 degree Fahrenheit temperature change. The thermal expansion of one of the eight-foot spans is approximately 0.0312 inches (1/32 inch). The thermal expansion of steel sheet 12 generates popping sounds as a result of the rubbing action of one hard metallic surface on another.

As will be hereinafter more fully explained, an ideal sound deadening material positioned between the upper surfaces of purlins 20 and lower surfaces of steel sheets 12 for preventing the popping noises is a thin relatively soft, compressible sound absorbing material which permits relative movement of the upper and lower surfaces of the sound deadening material a distance of at least the distance the span moves as a result of thermal expansion or contraction. In the example above, assuming that pins 12*c* securing corrugated sheet 12 to purlins 20 securely attaches the sheet 12 to the intermediate supporting purlins 20, then the thinned expansion will be equally divided between the supporting purlins 20. This thermal expansion will cause the corrugated steel sheets 12 to buckle upwardly or downwardly, since the sheet 12 cannot move along its length due to being restrained by the supporting purlins. In the example above, the eight-foot span, when experiencing a fifty degree temperature change would expand approximately 1/32 inch which would result in either a slight vertical movement of contact points between the steel deck 12 and purlin 20 which may result in a sudden impact or deformation of the steel sheet 12 at contact points with purlin 20. In the event that the steel corrugated sheet 12 is already in contact with surfaces of purlin 20, the thermal expansion may result in slight sliding action of surfaces in a horizontal direction. In either case, we have found that positioning sound deadening material between the lower surface of sheet 12 and the upper surface of purlin 20 alleviates the problem. The sound deadening material should be sufficiently resilient to permit relative movement between sheet 12 and purlin 20 in a horizontal or vertical direction by an amount sufficient to accommodate the thermal expansion of the span distance between purlins 20 of sheet 12. The materials hereinafter described are selected to provide a cushioning effect resulting from vertical movement which may result from slight buckling of sheets 12 as a result of thermal expansion and also to keep the surfaces separated to prevent generation of noise as a result of wiping action which may result from horizontal movement of lower surfaces of sheet 12 relative to contact points with purlin 20. Heretofore, vapor barriers, constructed of materials which have good resistance to the passage of water vapor and gasses have been positioned above and below corrugated sheets in decks. Such vapor barriers have included polyethylene fill, asphalt saturated felt, metal foil and vinyl sheet material. These vapor barriers generally have hard impervious surfaces and consequently are not sufficiently resilient to permit deformation of the material vertically or horizontally to function as a sound barrier to eliminate the popping sounds hereinbefore described. It is important that the material be compressible to absorb energy as the deck expands or contracts. The sound deadening material functions as a resilient cushion or shock absorber.

Materials such as EPDM, Neoprene rubber, felt which is not saturated with asphalt or tar, and inorganic felt are soft, pliable, porous and generally noncombustible. These materials are sufficiently resilient, capable of being deformed by shear loading to permit movement of the lower surface of the material relative to the upper surface when oppositely directed forces are applied to upper and lower surfaces of the material. Further, the materials provide a cushioning effect and deform slightly when forces are applied generally perpendicular to upper and lower surfaces of the material.

Referring to FIGS. 1, 2 and 3 of the drawing, a strip 25 of sound deadening material is positioned to extend longitudinally of the upper surface of each purlin 20 for separating the upper surface of the purlin from the lower surface of the steel sheet 12. Strip 25 of sound deadening material is preferably formed of heavy glass reinforcing felt or polymeric membrane, such as vulcanized ethylene propylene diene terpolymer (EPDM). However, other elastomeric polymer materials which are generally classified as "M" class rubbers may be used. Further disclosure of the EPDM material can be found in U.S. Pat. No. 4,783,942 entitled "COMPOSITE ROOF DECK ASSEMBLY WITH POLYMERIC MEMBRANE ADHERED TO FIBERGLASS MAT."

For maintaining the diaphragms performance and stiffness, the thickness of the sound deadening material 25 positioned between the upper surface of purlins 20 and the lower surface of corrugated sheet 12 and sheet 30 positioned above corrugated sheet 12 is preferably less than about ½ inch.

Powder actuated pins 21 extend through valley 13 of corrugated sheets 12 of high tensile steel, through strip 25 of sound deadening material and the upper flange of purlin 20. Suitable power actuated pins for metal deck attachment are commercially available for ITW Buildex, product number BX14.

Referring again to FIGS. 1, 2 and 3 of the drawing, a sheet 30 of sound deadening material is positioned to cover ridges 11 of corrugated sheets 12 to separate upper surfaces of the sheet 12 from the lower surface of thermal insulation material 14. If the optional sheet of thermal insulation material is not utilized, sheet 30 of sound deadening material would engage the lower surface of mineral board 16 or any other material positioned therebetween.

Figure 4:
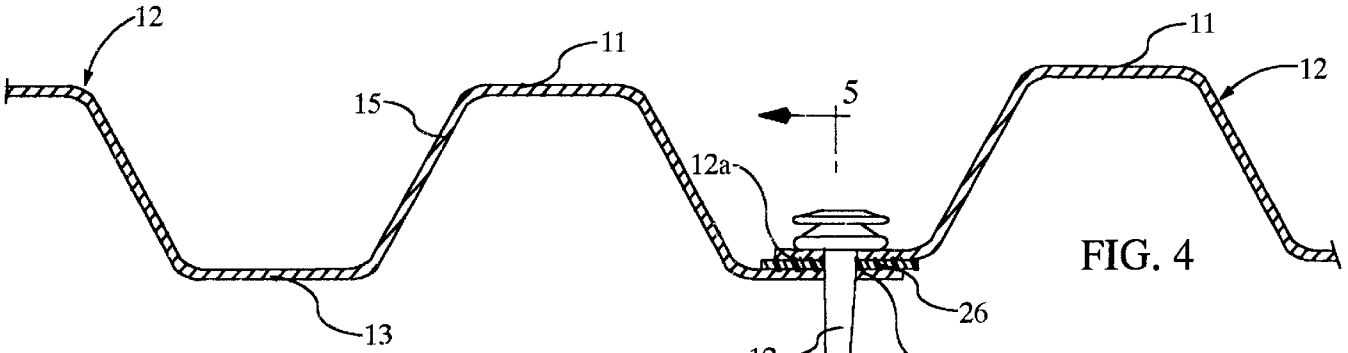
FIG. 4 is a cross-sectional view taken through overlapping side edges of corrugated steel sheets separated by a sound deadening strip.

As best illustrated in FIG. 4 of the drawing, each corrugated sheet 12 has side edges 12*a* and 12*b* which are positioned in overlapping relation to form joints between adjacent sheets 12 of corrugated material. Strips 26 of sound deadening material are positioned between the lower surface of edge 12*a* of one sheet and the upper surface of edge 12*b* of an adjacent sheet 12 such that the metallic surfaces on sheets 12 are separated by the strip 26 of sound deadening material. Side edges 12*a* and 12*b* preferably overlap about three inches and are secured together by pins 12*c* or sheet metal screws (not shown).

Figure 5:
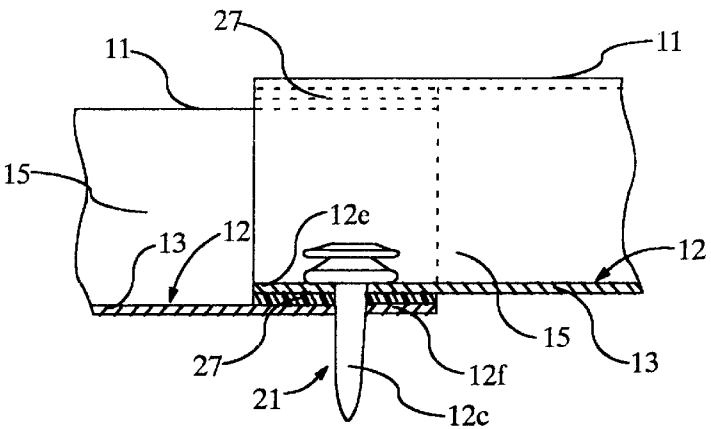
FIG. 5 is a cross-sectional view through overlapping end edges separated by a sound deadening strip, taken along line 5—5 of FIG. 4.

As best illustrated in FIG. 5 of the drawing, end edges 12*e* and 12*f* on adjacent sheets 12 are positioned one above the other to form overlapping joints separated by a strip 27 of sound deadening material and secured together by pins 12*c*' or sheet metal screws (not shown). Edges 12*e* and 12*f* preferably overlap about four inches.

Figure 6:
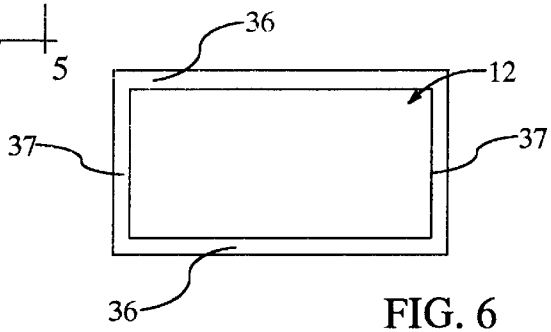
FIG. 6 is a diagrammatic plan view of a corrugated sheet illustrating sprayed-on side strips and end strips of sound deadening material.

In the embodiment of the invention illustrated in FIG. 6 of the drawing, corrugated sheet 12 is provided with side strips 36 and end strips 37 of non-metallic material, such as polyurethane foam, sprayed onto the lower surface and positioned to extend around the periphery of corrugated sheet 12. In the embodiment illustrated in FIG. 6, sound deadening strips 36 and 37 may be applied to upper and lower surfaces of the corrugated sheet. However, in most instances strips 36 and 37 can be formed on only one surface, such as the top or the bottom of the sheet such that a strip 36 is positioned between overlapping side edges of adjacent sheets and sound deadening strips 37 are positioned between adjacent surfaces of end edges of adjacent sheets 12 to prevent physical contact between adjacent metal surfaces on the sheets.

Figure 7:
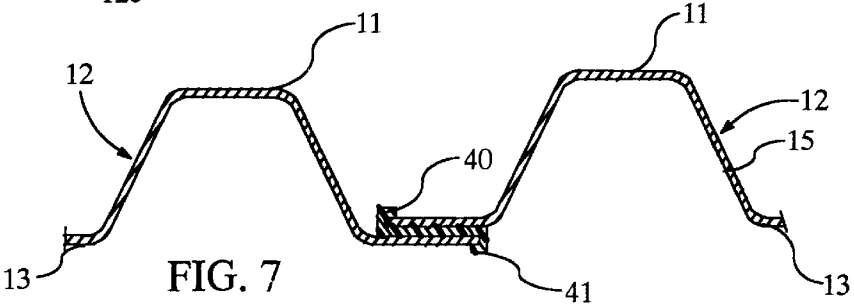
FIG. 7 illustrates a fourth embodiment wherein resilient molding strips are positioned around the periphery of adjacent corrugated sheets to form sound deadening strips between overlapping side edges and overlapping end edges of corrugated sheets.

In the embodiment of FIG. 7, resilient molding strips 40 and 41 are positioned to extend around the periphery of each corrugated sheet 12 such that molding strips are positioned in substantially the same position as the sprayed-on strips 35 and 37 illustrated in FIG. 6 of the drawing.

Strips 25, 26, 27, 36 and 37 and sheet 30 of sound deadening material are a porous material which does not block passage of vapor and has a relatively soft sound absorbing characteristic in both its composition and surface finish.

It should be understood that while the best mode of the invention hereinbefore described relates to a composite roof deck constructed with high tensile steel, it should be appreciated that the problem exists with conventional assemblies constructed of mild steel decking and we contemplate the use of sound deadening material disclosed herein in other and further assemblies. Further, while a roof deck has been disclosed, it should be understood that the invention applies to floor decks, walls and partitions.

Terms such as "left," "right," "horizontal," "vertical," "up" and down," when used in reference to the drawings, generally refer to the orientation of the parts in the illustrated embodiment and not necessarily during use. These terms used herein are meant only to refer to relative positions and/or orientations, for convenience, and are not to be understood to be in any manner otherwise limiting.

It should be readily apparent that other and further embodiments of the invention may be devised without departing from the spirit and scope of the appended claims.

Having described the invention, we claim:

1. A steel roof deck diaphragm to provide structural rigidity to a building wherein loads of varying intensity can cause movement of structural members, which tends to generate noise when two members rub or work against each other, the roof deck comprising:

purlins spaced apart a predetermined distance to form spans;

corrugated sheets of steel supported from below and spanning the distance between said purlins, said corrugated sheets having overlapping side edges and end edges and upper and lower surfaces;

spacer means between said overlapping side edges and end edges, said spacer means being configured to vertically space said upper and lower surfaces to prevent generation of noise resulting from relative movement of the corrugated sheets; and fastener means for securing said overlapping side edges and for securing said overlapping end edges.

2. A steel roof deck diaphragm according to claim 1, said fastener means comprising screws extending through adjacent side edges and through adjacent end edges.

3. A steel roof deck diaphragm according to claim 1, said spacer means between said overlapping side edges and end edges comprising: strips of felt.

4. A steel roof deck diaphragm according to claim 1, said spacer means between said overlapping side edges and end edges comprising: strips of tape.

5. A steel roof deck diaphragm according to claim 1, said spacer means between said overlapping side edges and end edges comprising: strips of sprayed-on polymeric material.

6. A steel roof deck diaphragm according to claim 1, said spacer means between said overlapping side edges and end edges comprising: strips of generally channel-shaped edge molding.

7. A roof deck diaphragm according to claim 1 with the addition of a sheet of flat rigid material secured to ridges of the corrugated material; and screws extending through the flat rigid material and anchored in the upper ridges of the corrugated material to form a truss extending transversely of the ridges, said truss being generally parallel to and spaced between said purlins.

8. A roof deck diaphragm according to claim 1, each of said corrugated sheets of steel having a plurality of spaced ridges alternating above a neutral axis forming compression ridges and below the neutral axis forming tension ridges, said spaced ridges extending longitudinally of said corrugated sheet;

a rigid sheet having a front face and a back face; and a sheet of sound deadening material between the compression ridges and the back face of the rigid sheet, said fastener means securing said rigid sheet to said compression ridges of said corrugated sheet with the sheet of sound deadening material therebetween.

9. A deck assembly according to claim 8 further comprising: a layer of thermal insulation interposed between said rigid sheet and said corrugated sheet.

10. A deck assembly according to claim 1 wherein said spacer means between overlapping side edges and end edges comprise: strips of resilient material having a width varying from approximately 3 inches to 4 inches.

11. A roof deck assembly comprising:

(a) spaced horizontally disposed roofjoists;

(b) a corrugated sheet of material, said corrugated sheet having a plurality of spaced ribs alternating above the neutral axis forming compression ribs and below the neutral axis forming tension ribs, said spaced ribs extending longitudinally of said corrugated sheet and said corrugated sheet being supported on said roof joists;

(c) a layer of thermal insulation superposed over said corrugated sheet;

(d) a sheet of resilient sound deadening material between said corrugated sheet and said thermal insulation; and (e) means to secure said layer of thermal insulation to said compression ribs, said means having a longitudinal extent extending through said layer of insulation and capturing said sheet of sound deadening material between said layer of thermal insulation and said corrugated sheet.

12. A roof deck assembly according to claim 11, said sheet of resilient sound deadening material comprising: roofing felt.

13. A roof deck assembly comprising:

spaced steel purlins having upper surfaces;

a rigid steel deck spanning between said spaced steel purlins, said steel deck being formed of a plurality of sheets, each sheet having side edges, end edges and upper and lower surfaces;

non-metallic sound deadening material; and means securing said steel deck to said steel purlins, such that said non-metallic sound deadening material is positioned between upper surfaces on said steel purlins and lower surfaces on said steel sheets.

14. A roof deck assembly according to claim 13, said steel deck comprising: sheets of corrugated steel; and means securing said sheets, such that said non-metallic material is positioned between upper and lower surfaces on said sheets to form overlapping side edge joints and overlapping end edge joints.

15. A roof deck assembly according to claim 13, said corrugated sheet of material comprising: a plurality of corrugated sheets of steel, said corrugated sheets having overlapping side edges and overlapping end edges and upper and lower surfaces; strips of sound deadening material extending along said side edges and end edges of said corrugated sheets; and fastener means for securing said overlapping side edges and for securing said overlapping end edges such that said sound deadening material prevents rubbing of adjacent upper and lower surfaces of said corrugated sheet upon relative movement of the corrugated sheets.

16. A roof deck assembly according to claim 15, said strips of sound deadening material comprising polymeric material.

17. A roof deck assembly according to claim 15, said strips of sound deadening material between said roof joists and said corrugated sheet comprising: strips of fiberglass felt.

18. A method of forming a deck comprising the steps of:

positioning sound deadening material between steel supporting members and steel sheets; and securing the steel sheets to the supporting members such that upon movement of the steel sheet relative to the supporting structure the sound deadening material is maintained in a position to prevent generation of popping sounds upon movement of surfaces on the sheet relative to the supporting structure.

19. The method of claim 18 wherein the sound deadening material is compressible for absorbing energy and to prevent impact of a surface the steel sheet against a surface on the supporting structure.

20. A method according to claim 18, with the addition of the step of positioning sound deadening material between adjacent side edges and adjacent end edges of steel sheets secured together to form overlapping joints.

* * * * *

UNITED STATES PATENT AND TRADEMARK OFFICE

CERTIFICATE OF CORRECTION

PATENT NO. : 6,250,036 B1
DATED : June 26, 2001
INVENTOR(S) : Nunley et al.

It is certified that error appears in the above-identified patent and that said Letters Patent is hereby corrected as shown below:

Title page,
Item [12], change "Nurley" to read -- Nunley --.
Item [75], change "Nurley" to read -- Nunley --.

Column 5,
Line 10, change "sufficient" to read -- insufficient --.
Line 53, change "thinned" to read -- thermal --.

Column 6,
Line 18, change "fill" to read -- film --.

Signed and Sealed this

Twenty-seventh Day of August, 2002

*Attest:*

*Attesting Officer*

JAMES E. ROGAN
*Director of the United States Patent and Trademark Office*